US008707494B1

(12) United States Patent
Berglund et al.

(10) Patent No.: US 8,707,494 B1
(45) Date of Patent: Apr. 29, 2014

(54) MODULAR FLOATING FRAME STRUCTURE FOR USE WITH PONTOONS

(71) Applicants: Bruce Paul Berglund, Centennial, CO (US); Ronald Scott Davis, Englewood, CO (US)

(72) Inventors: Bruce Paul Berglund, Centennial, CO (US); Ronald Scott Davis, Englewood, CO (US)

( * ) Notice: Subject to any disclaimer, the term of this patent is extended or adjusted under 35 U.S.C. 154(b) by 0 days.

(21) Appl. No.: 13/755,983

(22) Filed: Jan. 31, 2013

(51) Int. Cl.
*E01D 15/20* (2006.01)

(52) U.S. Cl.
USPC ..... 14/27; 14/2.4; 114/264

(58) Field of Classification Search
USPC ..... 14/2.4, 27; 114/264
See application file for complete search history.

(56) References Cited

U.S. PATENT DOCUMENTS

| | | | | |
|---|---|---|---|---|
| 3,450,084 | A * | 6/1969 | Gerbracht | 114/283 |
| 5,888,024 | A * | 3/1999 | Mills et al. | 405/219 |
| 6,089,176 | A * | 7/2000 | Costello | 114/267 |
| 6,311,632 | B1 * | 11/2001 | Noel, Jr. | 114/61.1 |
| 6,371,040 | B1 * | 4/2002 | Hemphill et al. | 114/219 |
| 6,619,224 | B1 * | 9/2003 | Syfritt | 114/352 |
| 6,666,162 | B2 * | 12/2003 | Allison | 114/355 |
| 6,860,221 | B1 * | 3/2005 | Henderson | 114/352 |
| 6,945,575 | B2 * | 9/2005 | Thompson | 292/340 |
| 7,644,674 | B1 * | 1/2010 | Goldston | 114/123 |
| 2006/0219148 | A1 * | 10/2006 | Olthuis | 114/266 |
| 2009/0145345 | A1 * | 6/2009 | Newcomb | 114/248 |
| 2012/0216735 | A1 * | 8/2012 | Bailey et al. | 114/55.55 |

* cited by examiner

*Primary Examiner* — Raymond W Addie

(57) ABSTRACT

A modular frame structure that can accept buoyancy members for construction of floating structures such as boats, rafts, barges, bridges and other platforms includes generally L-shaped planar sheet form drop gussets having horizontal and vertical leg portions provided with respective upper and lower receivers for connection to upper and lower tubular frame members.

19 Claims, 10 Drawing Sheets

105
105
105

MODULAR FLOATING FRAME STRUCTURE FOR USE WITH PONTOONS

1. FIELD OF THE INVENTION

The application relates to the field of modular frames for use being combined with pontoons in floating structures such as boats, rafts, barges, docks, bridges and platforms.

2. DESCRIPTION OF THE RELATED TECHNOLOGY

U.S. Pat. No. 183,777 which issued to J. Rider on Oct. 31, 1876 discloses a pontoon life-raft including a frame formed by longitudinal timbers and lateral braces. The lateral braces support a deck disposed below between and below the top surface of the pontoons.

U.S. Pat. No. 4,892,052 which issued to Zook et al. on Jan. 9, 1990 discloses a boat decking system for a pontoon boat which includes a frame formed from aluminum planks and rails secured by threaded fasteners.

U.S. Pat. No. 6,311,632 which issued to Noel, Jr. on Nov. 6, 2001 discloses a portable pontoon craft including a frame having three horizontally spaced apart arcuate harness members overlapping pontoons for securing a chair to the frame.

U.S. Pat. No. 7,263,940 which issued to Yetter et al. on Sep. 4, 2007 discloses a modular pontoon frame for use in floating structures such as a boat, dock, duck blind or platform. The frame includes floor support beams transversely attached to pontoon connector beams by threaded fasteners to facilitate assembly and disassembly.

U.S. Pat. No. 7,832,348 which issued to Newcomb on Nov. 16, 2010 discloses an emergency pontoon watercraft having a frame formed from tubular aluminum members configured to support a deck structure below and between the top surfaces of attached pontoons.

U.S. Published Patent Application No. 20070283869 published Dec. 13, 2007 discloses a pontoon boat including an open bay adapted to receive a personal watercraft.

U.S. Published Patent Application No. 20070295255 published Dec. 27, 2007 discloses a sectional modular pontoon boat including a railing assembly, a deck assembly formed by a plurality of interfitting panels and supported on spaced pontoons by a plurality of spaced cross supports.

U.S. Published Patent Application No. 20080236467 published Oct. 2, 2008 discloses a modular pontoon watercraft assembly including a plurality of ridged cross members. The entire disclosure of each of the aforementioned patents and published patent applications are incorporated herein by this reference thereto.

3. BACKGROUND OF THE INVENTION

Most pontoon boat designs feature a deck area located above the pontoons. In the case of inflatable pontoon boats, or catarafts, a frame design incorporates frame members supported on top of the inflatable pontoons with lower, lateral members forming a framework between the pontoons at midpoint for structural strength and rigidity.

This design either is decked at the level of the top of the pontoons or the deck is attached to the lower lateral and longitudinal frame members. In the case of the deck being attached to the frame on top of the pontoons, a high center of gravity is inherent. In the case of a deck being attached to the lower cross members, the deck is crossed by the upper lateral cross members precluding loading of the deck by wheeled means and requiring persons utilizing this type of craft to step over multiple frame members to travel from the front of the craft to the rear of the craft.

Typically the size of the craft is limited to the width of the frame, with the pontoons removed or attached, that can be legally transported on a trailer, by road, or the frame must be completely disassembled for transport or storage.

The present invention is intended to address the issues set forth above.

4. SUMMARY OF THE INVENTION

A modular floating frame assembly for use with pontoon in constructing floating structures such as boats, rafts, barges, docks, bridges and platforms. Includes generally L-shaped planar sheet form drop gussets having horizontal and vertical leg portions provided with respective upper and lower receivers for connection to upper and lower tubular frame members.

The drop gussets may be formed in mirror image left and right-hand versions with receivers projecting from only one face, or in a double receivers version with receivers oppositely projecting in aligned pairs from both front and back faces of the gusset.

The construction of modular frame sections in which the longitudinal tubular frame members are successively shorter would allow nested stacking of multiple frame sections for storage and transportation. The inflatable pontoons can be stored, deflated, inside the nested, stacked modular frame sections. These nested, stacked units can be stored on top of each other. This would allow storage of a large number of these crafts, and inflatable pontoons for them in areas prone to flooding. These stored craft would be of great use in rescue of persons trapped by flood water.

These frame sections can have lateral frame members of a length that exceed the legal width for our roads, and can still be carried nested lengthwise on a trailer, with minimal assembly of the modular frame sections required for launch.

To accommodate a pontoon, each of the gussets includes a recessed or cutaway lower region bounded by angular edges adapted to abut and be supported on the upper and side surfaces of respective pontoons.

The receivers on the gussets engage longitudinally and laterally extending tubular frame members. Decking planks may be secured to the frame to form upper and lower deck regions. This design using the drop gusset construction method, allows easy loading of wheeled loads including cargo carried by a dolly. Trailers, camper trailers and vehicles including cars and trucks can be loaded and carried on a craft using the drop gusset construction.

The drop gusset construction, with it's lower deck, has an inherently lower center of gravity than a craft with a deck located at the top of the pontoons, greatly enhancing its overall stability.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

5. BRIEF DESCRIPTION OF THE DRAWINGS

6. DETAILED DESCRIPTION OF THE PREFERRED EMBODIMENT(S)

Figures 1, 2:
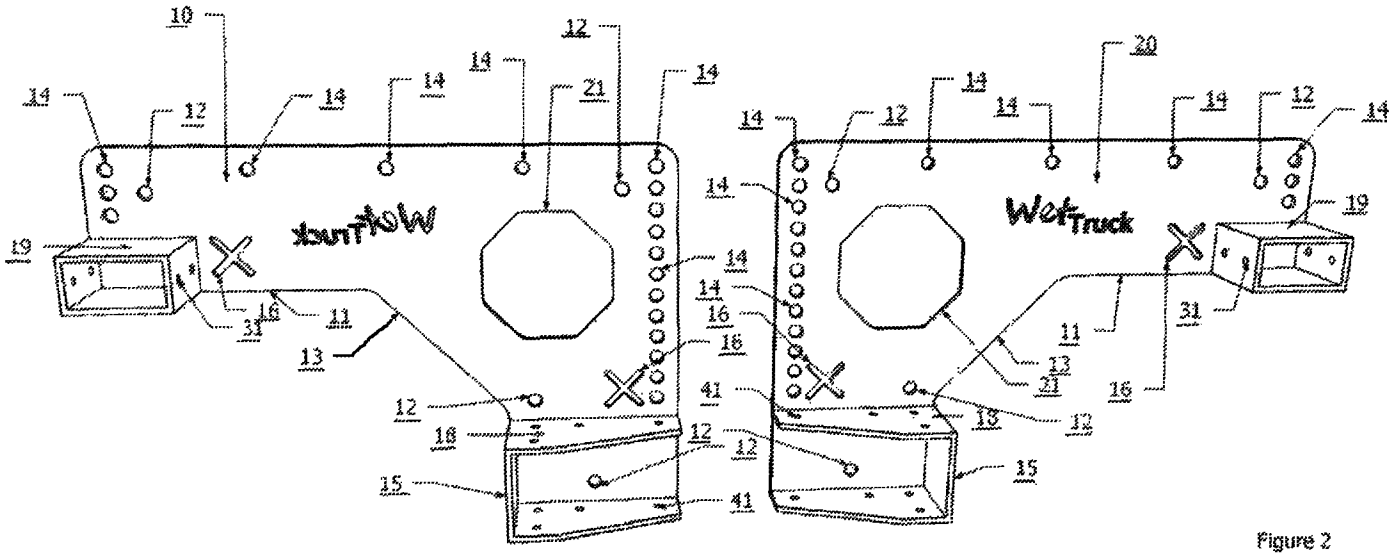
FIG. 1 is a front perspective view of a left-hand drop gusset used in the modular floating frame structure according to a first preferred embodiment of the present invention.
FIG. 2 is a front perspective view of a right-hand drop gusset used in the modular floating frame structure according to a first preferred embodiment of the present invention.

With reference to the drawings, and in particular to FIGS. 1 and 2, the modular floating frame structure according to the present invention includes a left-hand drop gusset 10 and a mirror image right-hand drop gusset 20.

The gussets 10 and 20 are each formed from a generally L-shaped plate, preferably aluminum, although others materials such as wood, fiberglass, plastic, carbon fiber, and galvanized, stainless, or powder coated steel may be employed without departing from the intended scope of the instant invention.

Injection molding methods may be employed to produce gussets formed from plastic resins.

Figure 7:
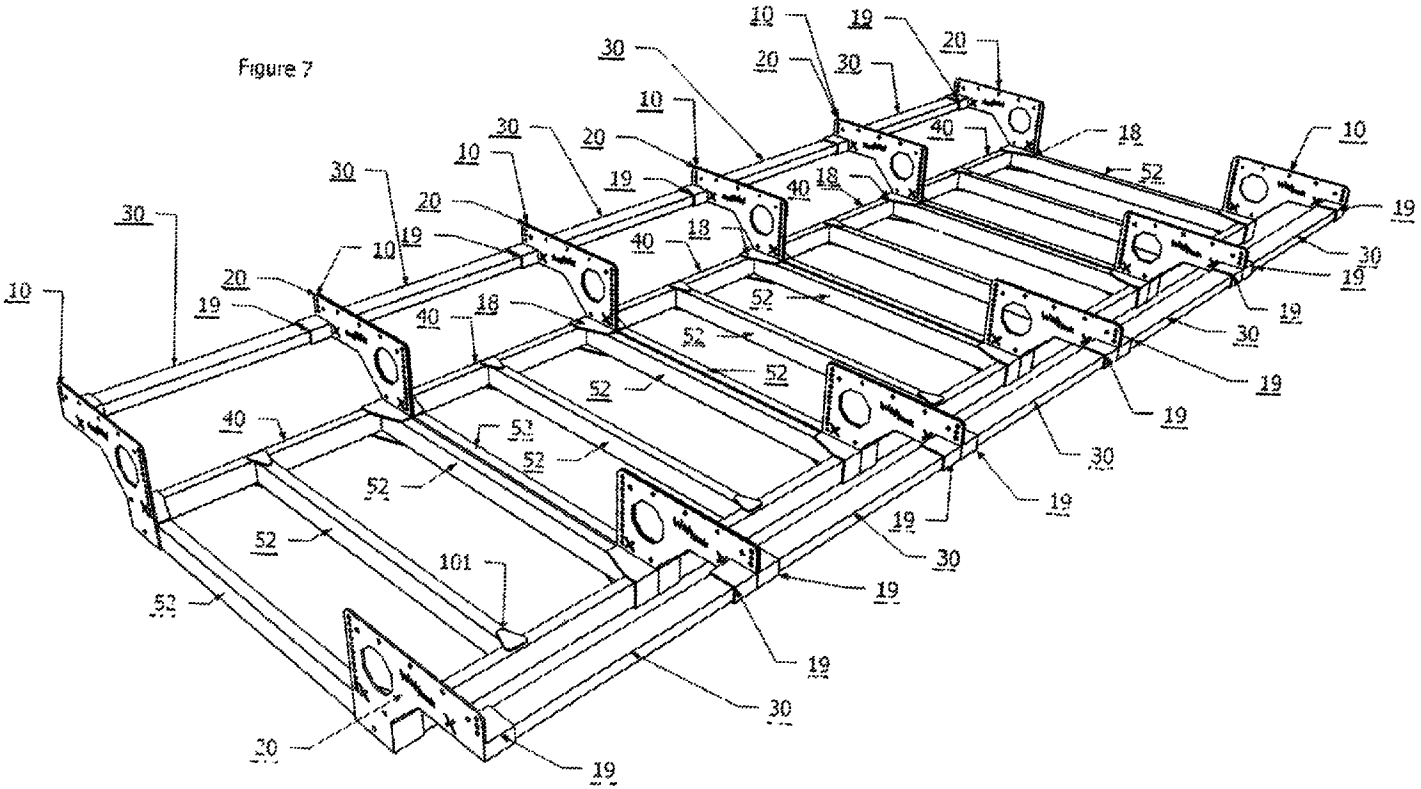
FIG. 7 is a perspective view illustrating an assembled modular floating frame structure according to the present invention.
Figure 8:
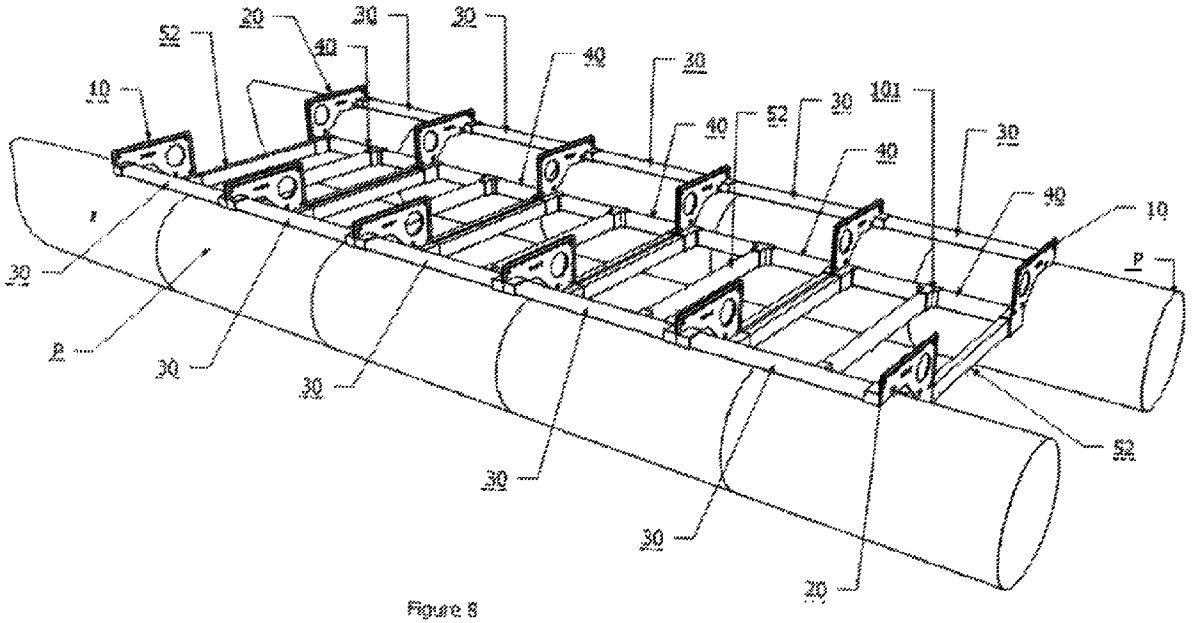
FIG. 8 is a perspective view illustrating an assembled pontoon boat using the modular floating frame structure according to the present invention.

In connection with a preferred embodiment of the invention, the gussets 10 and 20 are formed from 6061 aluminum plate having a thickness in the range of 1/16 inch to ½ inch depending on the intended load. The gussets 10 and 20 each include a plurality of holes 12 adapted to receive bolts for bolting the gussets 10 and 20 together in back to back abutting relationship, as shown in FIGS. 7 and 8.

Figure 6:
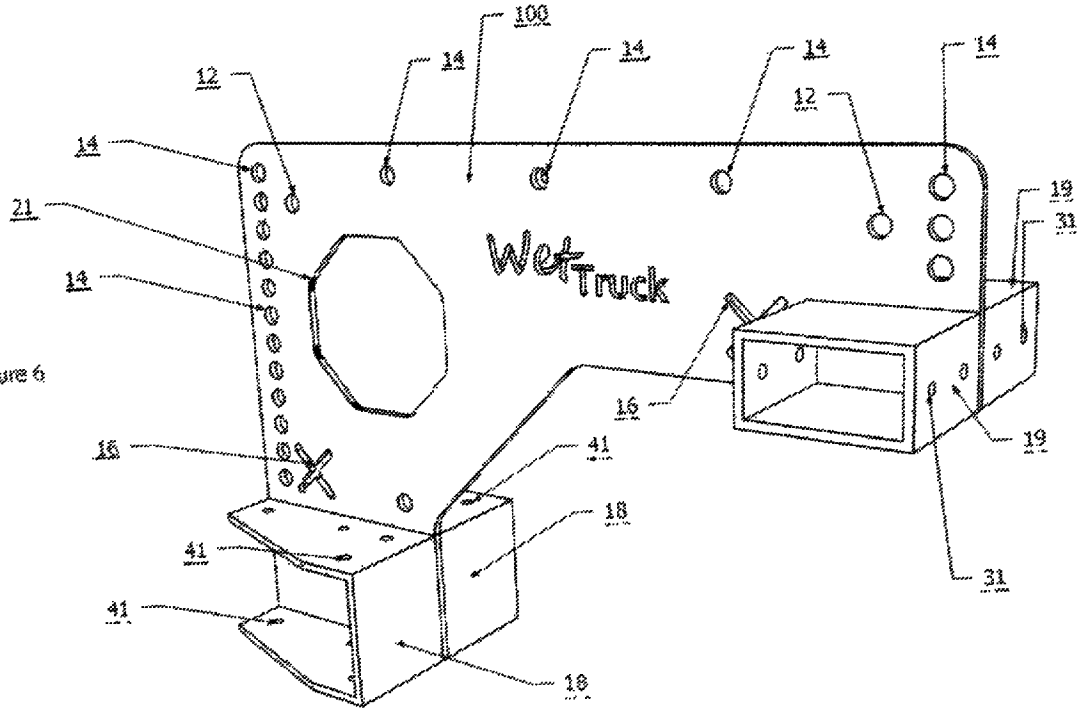
FIG. 6 is a perspective view of a drop gusset used in the modular floating frame structure according to a second preferred embodiment of the present invention for use when nested stacking of frame sections is not required.

The receivers include a plurality of holes 41 and 31 adapted to receive bolts for attaching lateral and longitudinal frame members to the receivers as shown in FIGS. 1 and 6. Suitable bolts include stainless steel or galvanized SAE grade 8 bolts in the range of ¼ inch to ⅝ inch diameter.

The size and proportions of the gussets 10 and 20 may be varied depending upon the intended use of the floating structure and the size of the associated pontoons used therewith. To accommodate a pontoon, each of the gussets 10 and 20 includes a recessed or cutaway lower region bounded by angular edges 11, 13, and 15 adapted to abut and be supported on the upper and side surfaces of respective pontoons. Pontoons of varying length and diameter can be used.

The gussets 10 and 20 each include a plurality of additional holes 14 adapted for optional securement of miscellaneous items such as a transom, railings, connector plates and other various assemblies. The gussets 10 and 20 each also preferably include substantially X-shaped cutouts 16 adapted for functioning to anchor a chain in a selected position along the length of the chain.

Each of the gussets 10 and 20 include a lower receiver 18 disposed at a lower end of a vertical leg portion of the gusset and an upper receiver 19 disposed at an end of a horizontal leg portion of the gusset, such that the receivers 19 are positioned at an elevation above the receivers 18.

An aperture 21 provided through each of the vertical leg portions of the gussets 10 and 20 allows for passing items such as rope, cable, fuel lines or the like through the assembled frame structure.

As an alternative to the use of receivers for connection of tubular frame members to the gussets 10 and 20, tubular frame members may be directly welded to the gusset plate structure.

Figure 3:
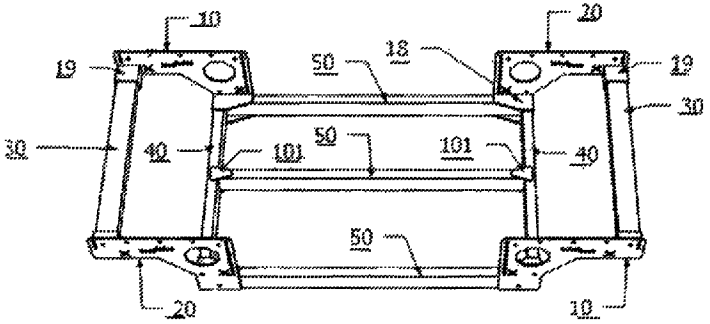
FIG. 3 is a perspective view of a narrower lateral width assembled frame section of the modular floating frame structure according to a first preferred embodiment of the present invention.
Figure 4:
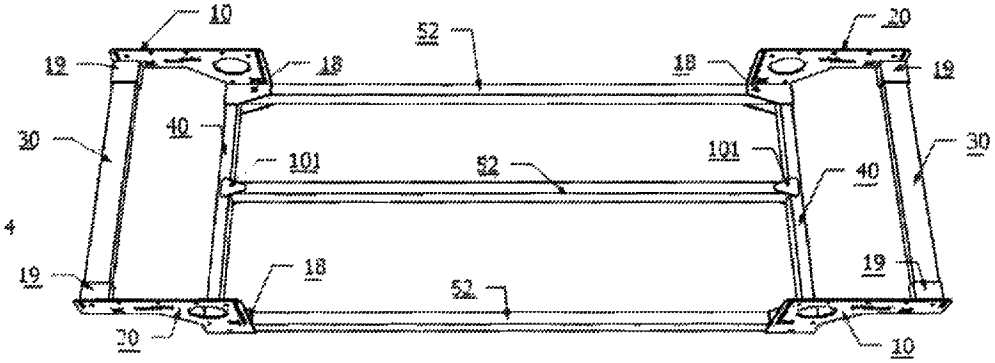
FIG. 4 is a perspective view of a wider lateral width assembled frame section of the modular floating frame structure according to a first preferred embodiment of the present invention.

With reference to FIGS. 3 and 4, a plurality of rectangular tubular longitudinal upper frame members 30 extend between and engage upper receivers 19, and a plurality of rectangular tubular longitudinal lower frame members 40 extend between and engage lower receivers 18 on each pair of juxtaposed drop gussets 10 and 20.

Transverse or lateral frame members 50, 52 also extend transversely between lower receivers 18 of longitudinally aligned pairs of drop gussets 10 and 20 to form a modular frame section.

As shown in FIGS. 3 and 4, the length of the lateral frame members may be shorter 50, or longer 52 to form floating structures of various sizes. The frame sections may also include one or more intermediate lateral frame members 50, 52 secured between lower longitudinal frame members 40 at a position spaced between the longitudinally spaced gusset pair 10, 20.

Figure 5:
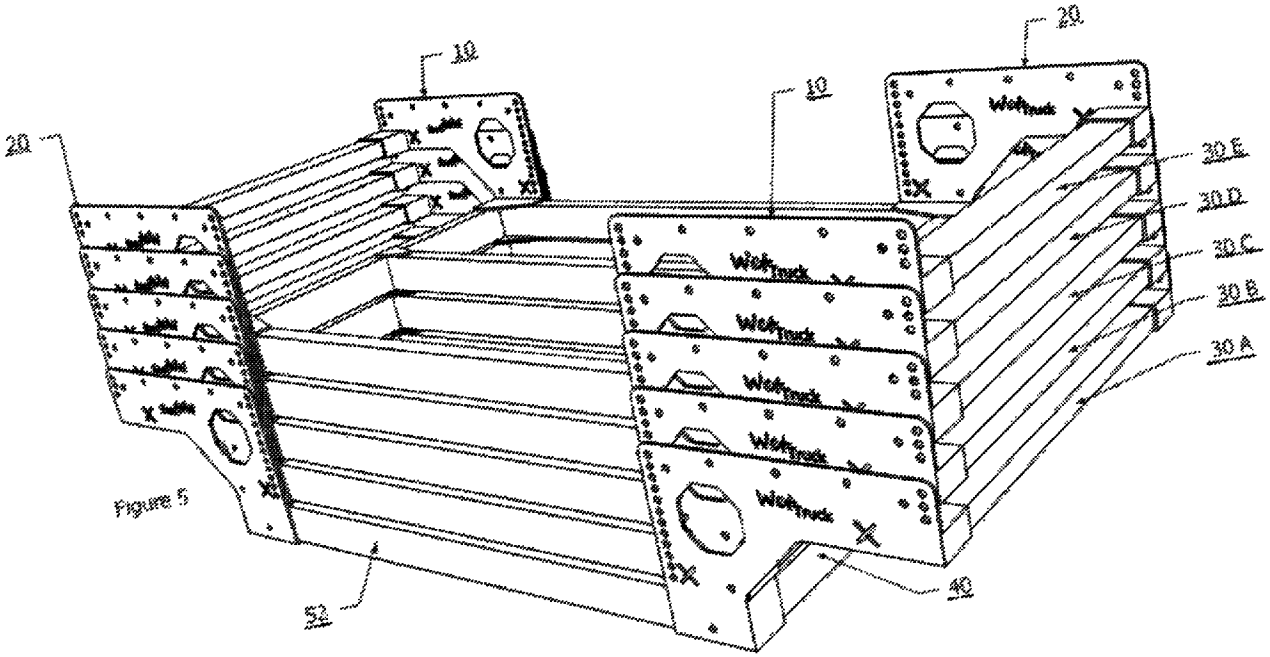
FIG. 5 is a perspective view illustrating nested stacked frame sections of the modular floating frame structure according to a first preferred embodiment of the present invention.

With reference to FIG. 5, multiple modular frame sections may be constructed so as to be stacked in nested relationship for transportation or storage by employing upper 30 and lower 40 longitudinal frame members in each modular frame section which are successively slightly shorter, preferably about one inch shorter, than corresponding frame members in the underlying modular frame section of the stack.

To further illustrate this configuration, if the upper longitudinal frame members 30A in the bottom most modular frame section have a length L, then 30B will have a length L−1 inch, 30C=L−2 inches, 30D=L−3 inches and 30E=L−4 inches. The length of the lower longitudinal frame members 40 in successive nested frame sections have a similar relationship. The nested stacking facilitates transportation in trucks, trailers and aircraft.

FIG. 6 illustrates a drop gusset according to a second preferred embodiment of the invention, in which aligned pairs of upper 19 and lower 18 receivers extend from opposite faces of the drop gusset. This alternative construction uses less material and is thus lighter and less expensive to produce, eliminates the assembly step of bolting gusset plates together, but precludes nested stacking of assembled modular frame sections as shown in FIG. 5.

FIG. 7 illustrates an assembled frame for a floating structure, without pontoons or decking in place. The transversely spaced drop gusset pairs 10, 20 at opposite ends of the frame are of the left and right-hand embodiments shown in FIGS. 1 and 2, respectively. The remaining drop gussets disposed intermediate the ends of the frame may be either of the type shown in FIGS. 1 and 2, in which drop gussets 10, 20 will be bolted together in back to back abutting relationship, or alternatively of the type gusset 100 shown in FIG. 6, provided with oppositely directed upper 19 and lower 18 pairs of receivers.

FIG. 8 illustrates an assembled floating frame structure, with a pair of conventional pontoons P secured to the frame. The pontoons may be of the inflatable type or may comprise rigid aluminum cylinders or the like. The pontoons may be secured to the frame in a variety of ways. For example, in the case of inflatable pontoons, a plurality of fabric straps spaced along the length of the pontoon may be employed. If rigid aluminum pontoons are used, straps, threaded fasteners or band clamps may be employed.

Figure 9:
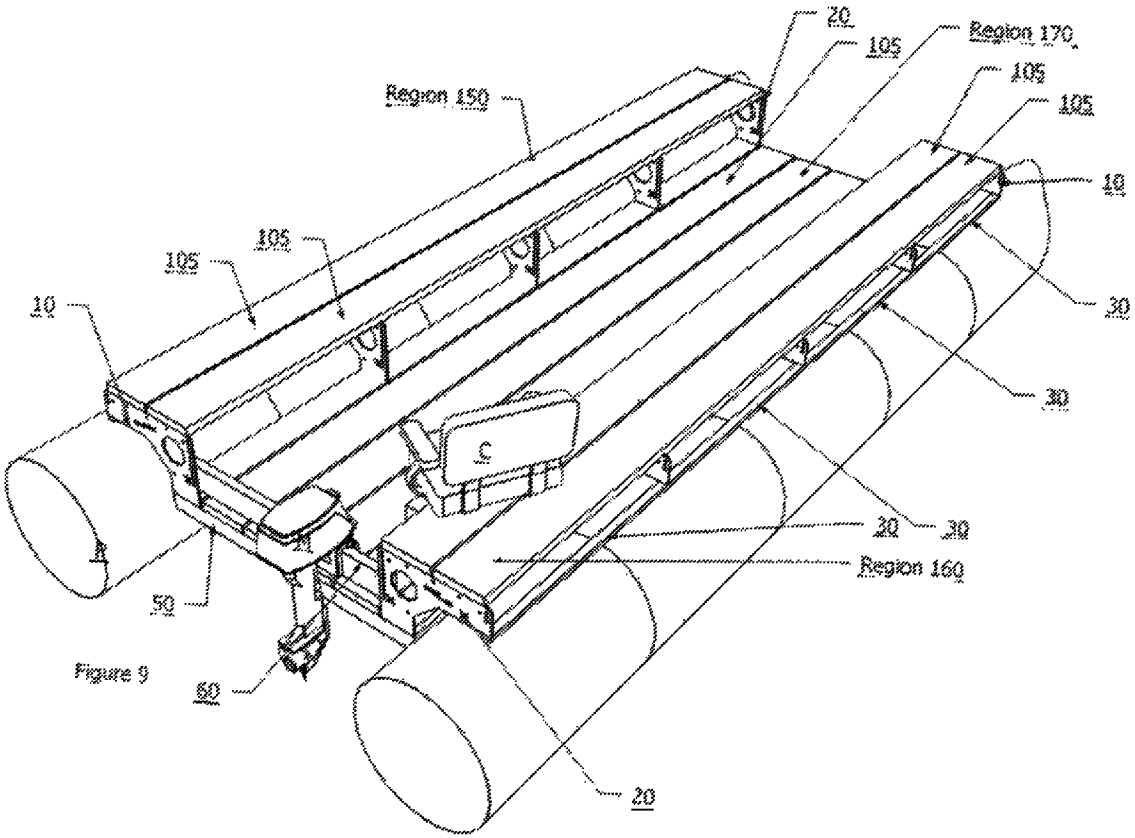
FIG. 9 is a rear top perspective view illustrating an assembled pontoon boat using the modular floating frame structure according to the present invention and including a deck structure.
Figure 10:
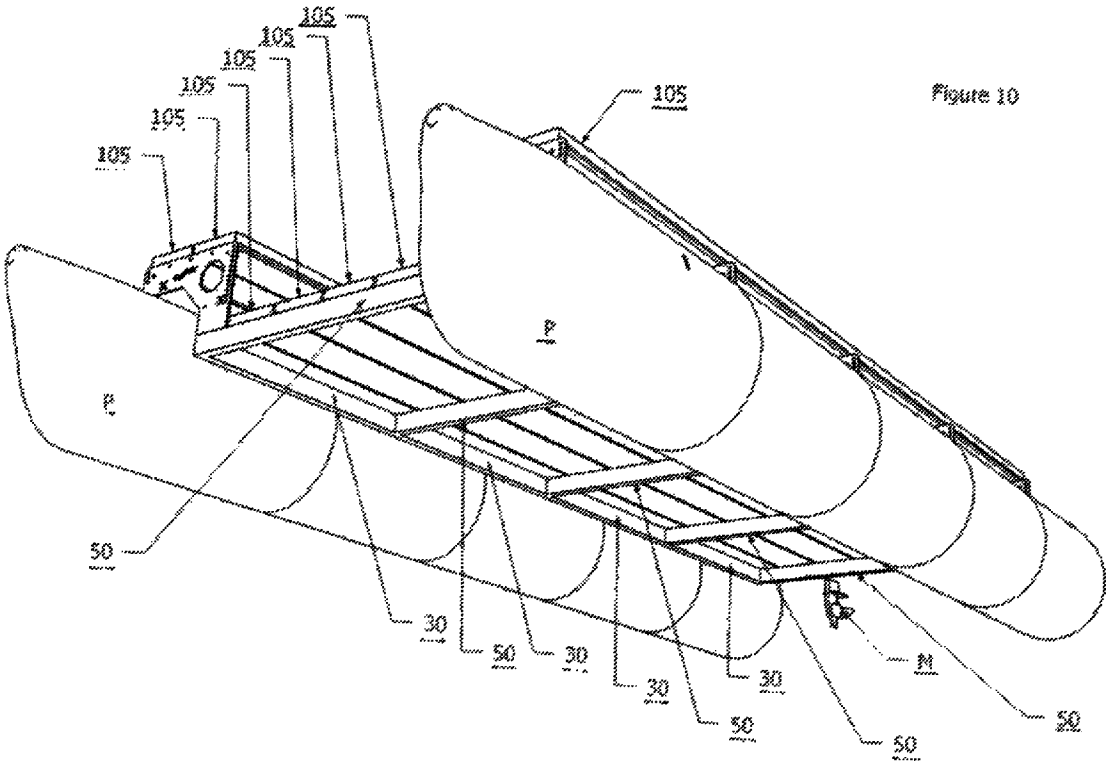
FIG. 10 is a front bottom perspective view further illustrating the pontoon boat of FIG. 9.

FIGS. 9 and 10 illustrate a pontoon boat constructed using the modular floating frame structure according to the present invention. The boat is constructed with drop gussets 20 and 10 that do not have receivers for lateral tubular frame members or longitudinal tubular frame members present in FIGS. 1, 2 and 6, instead the lateral and longitudinal tubular frame members 50 and 30 are welded directly to the drop gussets 20 and 10. This permits a lighter weight boat but precludes disassembly.

The boat includes decking constructed by bolting or otherwise fastening, such as by using clamps, screws or by welding, a plurality of decking planks 105 into position on the frame structure as shown to form left Region 150 and right Region 160 upper deck surfaces and a central lower deck surface Region 170.

The planks 105 may be formed from a variety of materials within the scope of the present invention, such as aluminum, steel, wood, composite wood-plastic decking material, plywood, carbon fiber or plastic.

With reference to FIG. 9, several important advantages of the frame structure according to the present invention may be appreciated. The use of the generally L-shaped drop gussets provides a central deck region 170 disposed below the top surface of the pontoons P, providing a low center of gravity, enhancing the stability of the boat. The central deck region is unobstructed, allowing convenient loading of gear, wheeling of a dolly, and walking.

The decking with planks as shown in FIG. 9, creates gear storage regions between each longitudinally spaced pair of gussets, beneath the upper deck regions 150 and 160.

Regions 150 and 160 may be used for seating. Additional seating such as conventional swivel captains chairs C may also be provided. A transom 60 is attached between the rear drop gussets 10 and 20 using fasteners through holes 14 allowing the use of conventional outboard motors M to propel the boat. A floating pontoon structure according to the present invention may be made extremely strong and rigid, sufficient, for example, to support a 10,000 pound truck.

Figure 11:
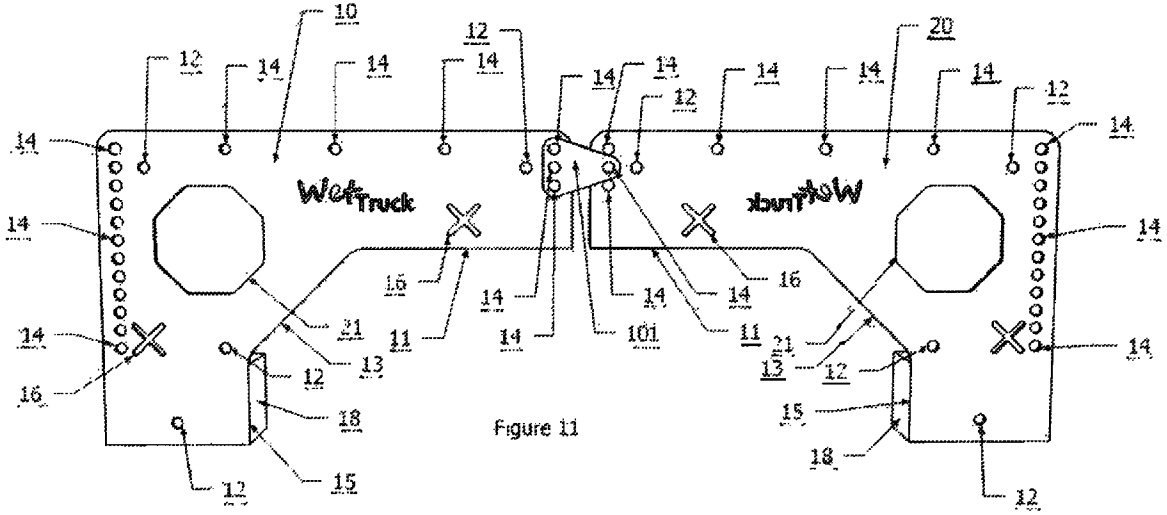
FIG. 11 is a front perspective view of mirror image gussets joined by a connector plate.

FIG. 11 shows a connecting plate 101 joining two mirror image gussets. Using these connector plates 101, a plurality of assembled frame sections (FIG. 3 or 4) may be joined together to form a floating structure of greater width. Using three bolts through the three holes on the left of the connector plate through the three holes on the upper, outside edge of the left gusset or gussets and one bolt through the right side of the connector plate and through the center hole at the upper outside edge of a mirror image gusset or gussets, allows the joined section or sections to move in relation to each other in a hinge-like fashion.

Figure 12:
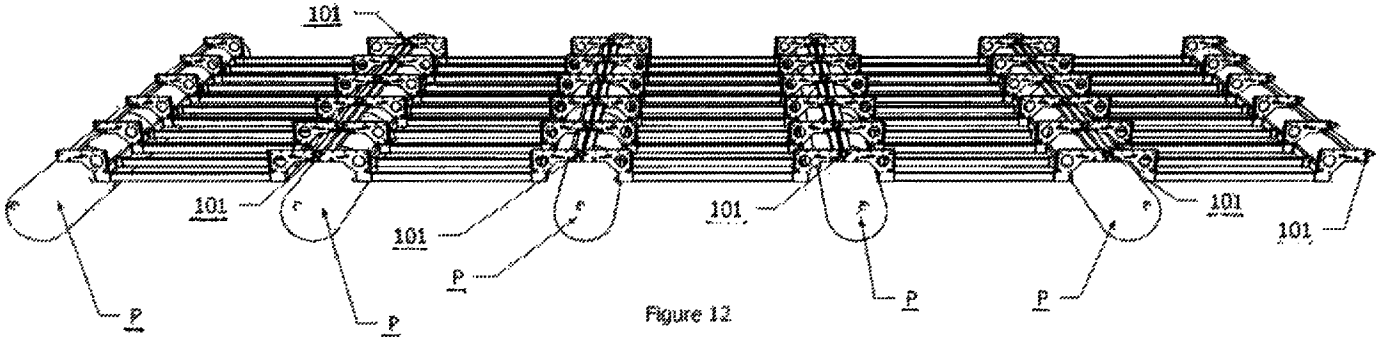
FIG. 12 is a front top perspective view of multiple frame sections joined to form a wide structure suitable for bridge or dock use.

FIG. 12 illustrates a floating bridge or dock, that can be readily assembled from a plurality of the same assembled frame sections of the preferred embodiment as shown in FIG. 3 or 4. Connector plates 101 fastened by bolts through the holes 14 at the upper, outside edge of the gussets as shown in FIG. 11 join all the assembled frame sections.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A modular frame structure, wherein the frame structure can accept a buoyancy member, comprising: at least one pair of left-hand drop frame gussets secured in spaced substantially parallel relation by at least one pair of longitudinal frame members; at least one pair of right-hand drop frame gussets secured in spaced substantial parallel relation by at least one pair of longitudinal frame members; and a plurality of transverse cross frame members securing said left-hand drop frame gussets and said right-hand drop frame gussets in laterally spaced relation.

2. The modular frame structure of claim 1, wherein each of said frame gussets comprises a substantially planar, generally L-shaped plate provided with a pair of transversely projecting receivers for engagement with said longitudinal frame members.

3. The modular frame structure of claim 2, wherein said receivers on each gusset are offset in elevation.

4. The modular frame structure of claim 2, wherein each of said gussets include a plurality of holes for bolting said gussets together, back to back, in abutting relationship.

5. The modular frame structure of claim 2, wherein each of said gussets includes an aperture for passing items such as rope, cable, fuel lines or the like through the assembled frame structure.

6. The modular frame structure of claim 2, wherein each of said gussets includes a substantially X-shaped cutout for use in securing chain.

7. The modular frame structure of claim 1, wherein said left-hand and right-hand drop frame gussets are minor images of one another.

8. A drop frame gusset for use in a modular frame structure, comprising: a substantially planar generally L shaped plate provided with a first pair of receivers projecting transversely from one face of said gusset for engagement with tubular frame members.

9. The drop frame gusset of claim 8, wherein said receivers on each gusset are offset in elevation.

10. The drop frame gusset of claim 8, further comprising a second pair of receivers projecting transversely from an opposite face of said gusset for engagement with tubular frame members.

11. The drop frame gussets of claim 8, wherein each of said gussets include a plurality of holes for bolting said gussets together, back to back, in abutting relationship.

12. The drop frame gusset of claim 8, wherein said left-hand and right-hand drop frame gussets are mirror images of one another.

13. A modular frame structure, comprising a plurality of modular frame sections, each of said frame sections including: two pairs of drop frame gussets connected by a plurality of longitudinal and lateral frame members; and wherein said frame sections are successively shorter in length such that said frame sections may be stored in nested stacked relation.

14. The modular frame structure of claim 13, wherein said drop frame gussets comprise at least one pair of left-hand drop frame gussets secured in spaced substantially parallel relation by at least one pair of longitudinal frame members; at least one pair of right-hand drop frame gussets secured in spaced substantially parallel relation by at least one pair of longitudinal frame members;

and a plurality of transverse cross frame members securing said left-hand drop frame gussets and said right-hand drop frame gussets in laterally spaced elation.

15. The modular frame structure of claim 14, wherein each of said drop frame gussets comprises a substantially planar generally L-shaped plate provided with a pair of transversely projecting receivers for engagement with said longitudinal frame members.

16. The modular frame structure of claim 14, wherein said receivers on each gusset are offset in elevation.

17. The modular frame structure of claim 14, wherein each of said gussets include a plurality of holes for bolting said gussets together, back to back, in abutting relationship.

18. The modular frame structure of claim 14, wherein said left-hand and right-hand drop frame gussets are minor images of each other.

19. A modular frame structure comprising:

A plurality of drop frame gussets, each having a substantially planar, generally L-shaped plate having at least one receiver, Wherein said plurality of drop frame gussets can be arranged in spaced relation by a plurality of longitudinal and lateral supports, and;

at least one buoyancy member coupled to at least one of said drop frame gussets to form large floating structures.

* * * * *